US011733623B2

(12) United States Patent
Tabata

(10) Patent No.: US 11,733,623 B2
(45) Date of Patent: Aug. 22, 2023

(54) IMAGE FORMING APPARATUS

(71) Applicant: CANON KABUSHIKI KAISHA, Tokyo (JP)

(72) Inventor: Yu Tabata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/893,733

(22) Filed: Aug. 23, 2022

(65) Prior Publication Data

US 2023/0064793 A1 Mar. 2, 2023

(30) Foreign Application Priority Data

Aug. 30, 2021 (JP) ..... 2021-139760

(51) Int. Cl.
*G03G 15/16* (2006.01)

(52) U.S. Cl.
CPC ..... *G03G 15/1665* (2013.01); *G03G 15/1645* (2013.01); *G03G 15/1675* (2013.01)

(58) Field of Classification Search
CPC ..... G03G 15/1645; G03G 15/1665; G03G 15/1675
See application file for complete search history.

(56) References Cited

U.S. PATENT DOCUMENTS

| | | | | |
|---|---|---|---|---|
| 11,474,458 | B2 * | 10/2022 | Matsumura | G03G 15/1675 |
| 2015/0016833 | A1 * | 1/2015 | Nakaegawa | G03G 15/1605 399/66 |
| 2016/0097994 | A1 * | 4/2016 | Ito | G03G 15/0189 399/88 |

FOREIGN PATENT DOCUMENTS

| | | | |
|---|---|---|---|
| JP | 2002-116643 | A | 4/2002 |
| JP | 2006-154006 | A | 6/2006 |
| JP | 2013-037032 | A | 2/2013 |
| JP | 2014-153398 | A | 8/2014 |

* cited by examiner

*Primary Examiner* — Joseph S Wong
(74) *Attorney, Agent, or Firm* — Venable LLP

(57) ABSTRACT

An image forming apparatus includes a sensing portion configured to sense a current that flows through a secondary transfer member, or a voltage that has been applied; and a controller configured to perform an operation to determine a transfer voltage to be applied to the secondary transfer member in secondary transfer, on a basis of a result of sensing performed by the sensing portion at a time when a test voltage has been applied to the secondary transfer member in non-image formation, and the controller performs, in the operation, controlling a first application portion and a second application portion not to apply the voltage to a primary transfer member during a period of applying the test voltage to the secondary transfer member.

7 Claims, 8 Drawing Sheets

FIG 8

| LEAKAGE CURRENT [μA] | IMAGE EVALUATION |
|---|---|
| 0 | ○ |
| 1 | ○ |
| 2 | ○ |
| 3 | △ |
| 4 | × |
| 5 | × |
| 6 | × |

IMAGE FORMING APPARATUS

BACKGROUND OF THE INVENTION

Field of the Invention

The present invention relates to an image forming apparatus such as a copying machine, a printer, or a facsimile machine.

Description of the Related Art

Conventionally, as an image forming apparatus such as a printer, a copying machine, or a facsimile machine, an image forming apparatus of an intermediate transfer system is known, and the image forming apparatus of the intermediate transfer system is provided with an intermediate transfer member having a belt shape in such a way that the intermediate transfer member faces each of a plurality of photosensitive drums serving as image bearing members. The image forming apparatus of the intermediate transfer system includes a plurality of primary transfer portions that transfers, to the intermediate transfer member, a toner image borne by each of the plurality of photosensitive drums, and a secondary transfer portion that transfers, to a recording medium, the toner image transferred to the intermediate transfer member. In addition, the intermediate transfer member is stretched among a plurality of support rollers, and passes through the plurality of primary transfer portions and the secondary transfer portion.

Conventionally, as a transfer roller of a transfer device, an elastic roller, such as a sponge roller, is widely used, and the elastic roller includes an elastic layer, such as a spongy formed layer, on a roller made of metal or on a core metal. Conductivity has been added to such an elastic roller by dispersing conductive powder, such as carbon black, in the elastic layer.

In such an elastic layer in which conductive powder has been dispersed, a variation in resistance occurs due to an environmental variation and a variation in durability. Therefore, conventionally, it has been requested that high-voltage control, such as active transfer voltage control (hereinafter referred to as "ATVC") be performed in such a way that a current that flows through the transfer roller at the time of image formation has a desired value. Here, ATVC is control in which a predetermined voltage is applied to a secondary transfer roller, and a voltage to be applied to the secondary transfer roller at the time of image formation is controlled based on a result of detecting a current that flows through the secondary transfer roller.

In addition, in the transfer device described above, in some cases, polarities of transfer biases to be applied to the primary transfer portion and the secondary transfer portion are different from each other. For example, in some cases, a positive polarity bias is applied to a transfer roller of the primary transfer portion, and a negative polarity bias is applied to a transfer roller of the secondary transfer portion. In these cases, there is a possibility that currents that respectively flow through the primary transfer portion and the secondary transfer portion will interfere with each other.

In view of this, Japanese Patent Application Laid-Open No. 2014-153398 discloses a transfer device and an image forming apparatus that include, between a primary transfer portion and a secondary transfer portion, at least two or more grounding places where an intermediate transfer member and a ground are connected directly or with a resistor interposed therebetween. By doing this, in a case where biases having polarities different from each other are applied to a transfer roller of the primary transfer portion and a transfer roller of the secondary transfer portion, interference between currents that respectively flow through the primary transfer portion and the secondary transfer portion can be avoided.

However, in Japanese Patent Application Laid-Open No. 2014-153398, in some cases, when ATVC is performed, a current that is to flow through a secondary transfer roller flows into a grounded roller, and therefore an appropriate current fails to be supplied to the secondary transfer roller, and this results in a deterioration in accuracy of ATVC. There is a problem in which these cases cause the defective transfer of a toner image at the time of image formation in some cases. In addition, in Japanese Patent Application Laid-Open No. 2014-153398, the grounding places are provided between the primary transfer portion and the secondary transfer portion, and there is a problem in which this results in an increase in size of an apparatus and an increase in a cost.

SUMMARY OF THE INVENTION

It is desirable that the present invention provide an image forming apparatus that is capable of reducing interference between currents that respectively flow through a primary transfer portion and a secondary transfer portion without causing defective transfer at the time of image formation, and is capable of avoiding an increase in size of the apparatus and an increase in a cost.

An image forming apparatus according to the present invention includes: an image forming portion configured to form a toner image on an image bearing member; a belt to which the toner image is transferred from the image bearing member; a primary transfer member configured to primarily transfer the toner image from the image bearing member to the belt; a first application portion configured to apply a voltage to the primary transfer member; a secondary transfer member configured to come into contact with an inner face of the belt and stretch the belt, and to secondarily transfer the toner image from the belt to a recording material; a second application portion configured to apply a voltage to the secondary transfer member; a sensing portion configured to sense a current that flows through the secondary transfer member, or the voltage that has been applied; and a controller configured to perform an operation to determine a transfer voltage to be applied to the secondary transfer member in secondary transfer, on a basis of a result of sensing performed by the sensing portion at a time when a test voltage has been applied to the secondary transfer member in non-image formation, in which the controller performs, in the operation, controlling the first application portion and the second application portion not to apply the voltage to the primary transfer member during a period of applying the test voltage to the secondary transfer member.

Further features of the present invention will become apparent from the following description of exemplary embodiments with reference to the attached drawings.

BRIEF DESCRIPTION OF THE DRAWINGS

FIG. 8 is a diagram illustrating a relationship between the leakage current and an image in the transfer device according to the embodiment of the present invention.

DESCRIPTION OF THE EMBODIMENTS

Figure 1:
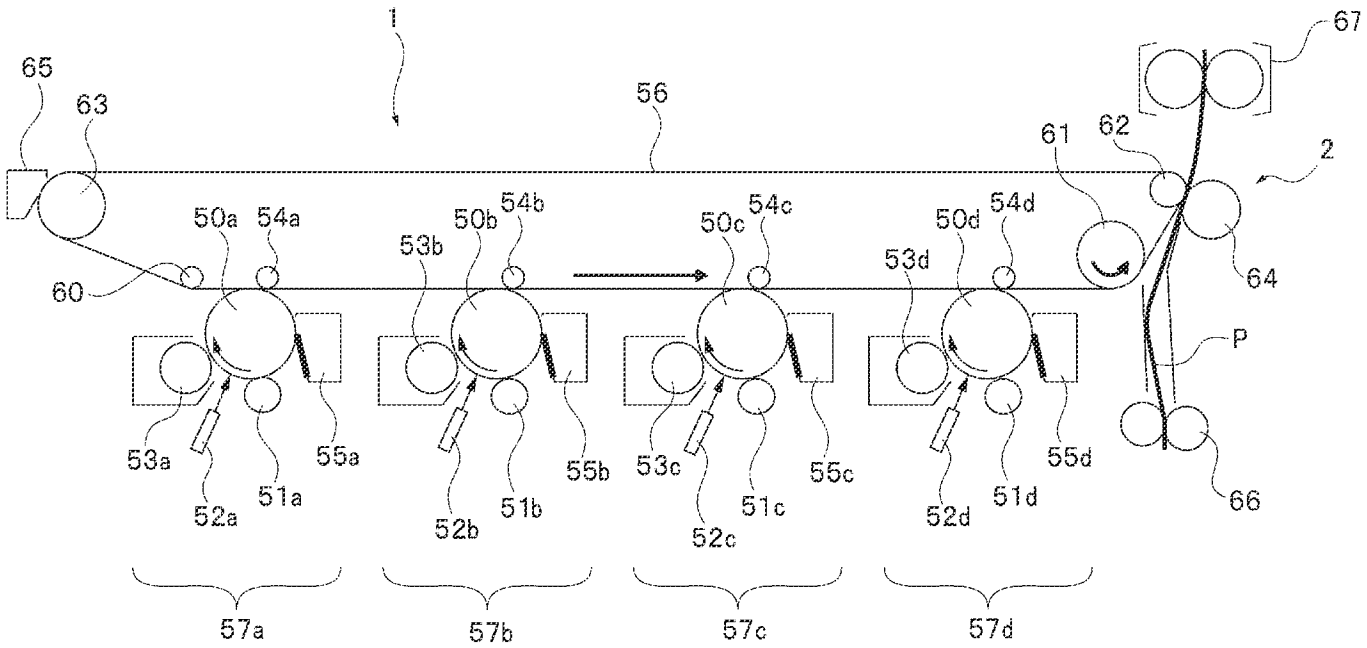
FIG. 1 is a schematic diagram of an image forming apparatus according to an embodiment of the present invention.

Embodiments are described in detail below with reference to the drawings.

<Configuration of Image Forming Apparatus>

A configuration of an image forming apparatus 1 according to an embodiment of the present invention is described in detail with reference to FIGS. 1 and 2.

The image forming apparatus 1 includes a transfer device 2, an image forming unit 57, a registration roller 66, a fixing portion 67, and an operation portion 81. Here, the image forming apparatus 1 is, as an example, an image forming apparatus having what is called a tandem-type intermediate transfer system of full color.

The transfer device 2 primarily transfers a toner image formed by the image forming unit 57 to an intermediate transfer belt 56, and secondarily transfers the toner image that has been primarily transferred to the intermediate transfer belt 56 to a sheet P conveyed by the registration roller 66. The transfer device 2 conveys, to the fixing portion 67, the sheet P that the toner image has been secondarily transferred to. Note that details of a configuration of the transfer device 2 will be described later.

The image forming unit 57 serving as an image forming portion includes a plurality of image forming units 57*a*, 57*b*, 57*c*, and 57*d*. The image forming units 57*a*, 57*b*, 57*c*, and 57*d* are disposed in the order of yellow (Y), magenta (M), cyan (C), and black (K) from an upstream side of a circling direction of the intermediate transfer belt 56. The image forming units 57*a*, 57*b*, 57*c*, and 57*d* are controlled by the controller 80 (described later) of the transfer device 2 to form toner images of respective color components by using an electrophotographic system.

Specifically, the image forming units 57*a*, 57*b*, 57*c*, and 57*d* include photosensitive drums 50*a*, 50*b*, 50*c*, and 50*d* and charging rollers 51*a*, 51*b*, 51*c*, and 51*d*. In addition, the image forming units 57*a*, 57*b*, 57*c*, and 57*d* include exposing devices 52*a*, 52*b*, 52*c*, and 52*d*, developing devices 53*a*, 53*b*, 53*c*, and 53*d*, and cleaning devices 55*a*, 55*b*, 55*c*, and 55*d*.

Figure 2:
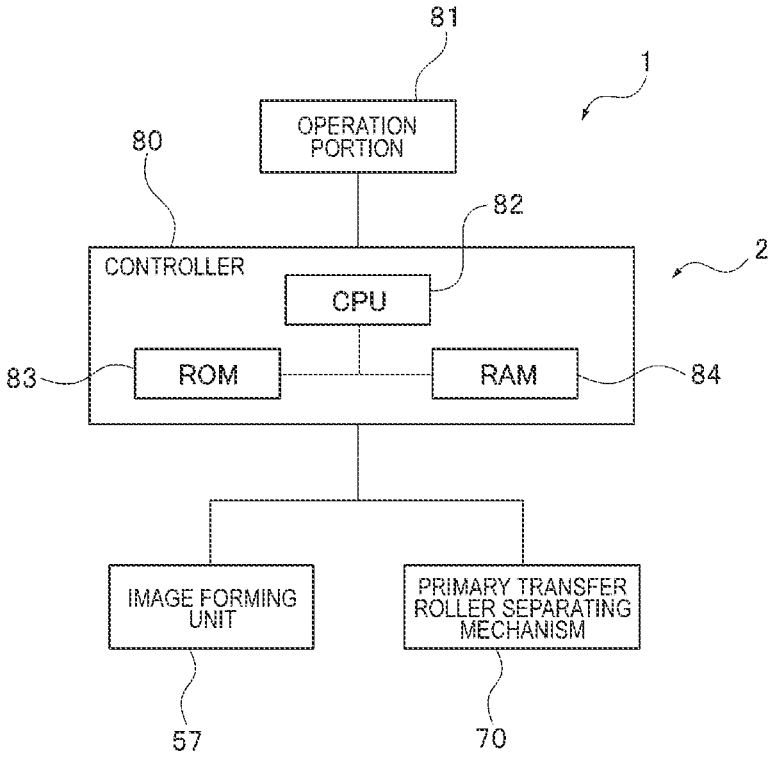
FIG. 2 is a block diagram illustrating a configuration of the image forming apparatus according to the embodiment of the present invention.

The photosensitive drums 50*a*, 50*b*, 50*c*, and 50*d* serving as an image bearing members rotate in a clockwise direction in FIG. 1.

The charging rollers 51*a*, 51*b*, 51*c*, and 51*d* charge the photosensitive drums 50*a*, 50*b*, 50*c*, and 50*d*.

The exposing devices 52*a*, 52*b*, 52*c*, and 52*d* form an electrostatic latent image on the photosensitive drums 50*a*, 50*b*, 50*c*, and 50*d*.

The developing devices 53*a*, 53*b*, 53*c*, and 53*d* supply toner to the electrostatic latent images on the photosensitive drums 50*a*, 50*b*, 50*c*, and 50*d*, and form toner images on the photosensitive drums 50*a*, 50*b*, 50*c*, and 50*d*, and therefore the developing devices 53*a*, 53*b*, 53*c*, and 53*d* change the electrostatic latent images to visible images.

The cleaning devices 55*a*, 55*b*, 55*c*, and 55*d* remove residual toner on the photosensitive drums 50*a*, 50*b*, 50*c*, and 50*d*.

The registration roller 66 conveys, to the transfer device 2, a sheet P that has been conveyed by a not-illustrated pickup roller at a predetermined timing.

The fixing portion 67 performs fixing processing on the toner image that has been secondarily transferred to the sheet P conveyed from the transfer device 2 to fix an image on the sheet P, and conveys the sheet P on which the image has been fixed toward a not-illustrated ejecting portion.

The operation portion 81 outputs, to the controller 80, an electric signal that corresponds to a user's operation. The operation portion 81 outputs, to the controller 80, an electric signal that corresponds to a user's operation to designate, for example, a sheet type or the like of a sheet P stacked on a not-illustrated tray.

<Configuration of Transfer Device>

Figure 3:
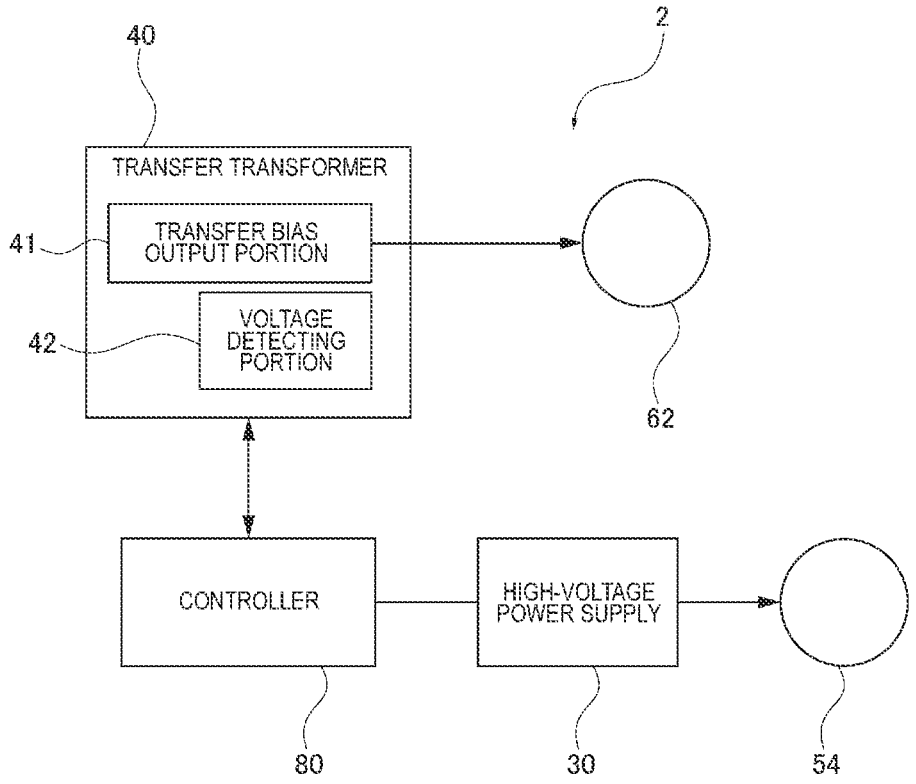
FIG. 3 is a block diagram illustrating a configuration of a transfer device according to the embodiment of the present invention.

A configuration of the transfer device 2 according to the embodiment of the present invention is described in detail with reference to FIGS. 1 and 3.

The transfer device 2 includes a high-voltage power supply 30, a transfer transformer 40, a primary transfer roller 54, the intermediate transfer belt 56, a tension roller 60, and an idler roller 61. In addition, the transfer device 2 includes a secondary transfer inner roller 62, a driving roller 63, a secondary transfer outer roller 64, an intermediate transfer belt cleaning device 65, a primary transfer roller separating mechanism 70, and the controller 80.

The high-voltage power supply 30 is controlled by the controller 80 to apply a primary transfer bias to the primary transfer roller 54, or stop applying the primary transfer bias.

The transfer transformer 40 is controlled by the controller 80 to apply a secondary transfer bias to the secondary transfer inner roller 62, or stop applying the secondary transfer bias. Specifically, the transfer transformer 40 includes a transfer bias output portion 41 and a voltage detecting portion 42.

The transfer bias output portion 41 is controlled by the controller 80 to apply the secondary transfer bias to the secondary transfer inner roller 62, or stop applying the secondary transfer bias.

The voltage detecting portion 42 serving as a detecting portion detects the secondary transfer bias applied to the secondary transfer inner roller 62, and outputs, to the controller 80, an electric signal that corresponds to a detection result.

A plurality of primary transfer rollers 54 serving as a primary transfer members is provided inside the intermediate transfer belt 56, and faces photosensitive drums 50 with the intermediate transfer belt 56 interposed therebetween. The primary transfer rollers 54 include a plurality of primary transfer rollers 54*a*, 54*b*, 54*c*, and 54*d* in association with the image forming units 57*a*, 57*b*, 57*c*, and 57*d*.

The primary transfer roller 54*d* is provided on a most downstream side of the circling direction of the intermediate transfer belt 56 from among the primary transfer rollers 54, and is closest to the secondary transfer inner roller 62 from among the primary transfer rollers 54. Note that the photosensitive drums 50*a*, 50*b*, 50*c*, and 50*d* are collectively referred to as the photosensitive drums 50, and the primary transfer rollers 54*a*, 54*b*, 54*c*, and 54*d* are collectively referred to as the primary transfer rollers 54.

The primary transfer roller 54 is a metal roller that has been formed by using stainless steel (SUS), free-cutting steels (SUM), or the like, and has a straight shape along a longitudinal direction. Here, a diameter of the primary transfer roller 54 is, as an example, 8 mm. The primary transfer roller 54 is connected to the high-voltage power supply 30, and at the time of image formation, a primary transfer bias having an opposite-polarity of a charging polarity of toner is applied from the high-voltage power supply 30. The primary transfer bias is applied, and therefore the primary transfer roller 54 performs primary transfer processing for sequentially electrostatically attracting and superimposing a toner image formed on the photosensitive drum 50 onto the intermediate transfer belt 56, and primarily transferring the toner image to the intermediate transfer belt 56.

The primary transfer roller 54 is disposed in such a way that a perpendicular line drawn from a central shaft of the primary transfer roller 54 to the intermediate transfer belt 56 is located on a downstream side in a direction of movement of the intermediate transfer belt 56 by a predetermined distance relative to a perpendicular line drawn from a central shaft of the photosensitive drum 50 to the intermediate transfer belt 56. Here, the predetermined distance is, as an example, 5 mm. Stated another way, in the present embodiment, in each of the image forming units 57*a*, 57*b*, 57*c*, and 57*d*, the primary transfer roller 54 and the intermediate transfer belt 56 are in contact with each other in a first contact portion, and the photosensitive drum 50 and the intermediate transfer belt 56 are in contact with each other in a second contact portion. The first contact portion and the second contact portion are disposed so as not to overlap each other in the direction of movement of the intermediate transfer belt 56. The primary transfer roller 54 can be displaced in an upward/downward direction in FIG. 1 by the primary transfer roller separating mechanism 70. The primary transfer roller 54 is displaced in the downward direction in FIG. 1, and therefore the primary transfer roller 54 can be pressed against the intermediate transfer belt 56, and presses down the intermediate transfer belt 56 by 0.1 mm to 0.3 mm on the downstream side in the direction of movement of the intermediate transfer belt 56 of the photosensitive drum 50.

The intermediate transfer belt 56 is disposed to face the photosensitive drum 50, extends along a direction of arrangement of the photosensitive drum 50, and moves in a predetermined circling direction. The intermediate transfer belt 56 moves in a counterclockwise circling direction in the case of FIG. 1.

The intermediate transfer belt 56 includes an endless belt that has a thickness of, for example, about 40 μm to 60 μm and has a film shape. The intermediate transfer belt 56 has been formed by causing a resin material such as polyimide or polyamide, a compound of this resin material, rubber, or the like to contain an appropriate amount of antistatic agent such as carbon black. The intermediate transfer belt 56 has been formed in such a way that a surface resistivity is greater than or equal to 1E+10 Ω/sq and is less than or equal to 1E+11 Ω/sq.

Toner images of respective color components that have been formed in the respective photosensitive drums 50*a*, 50*b*, 50*c*, and 50*d* by the respective image forming units 57*a*, 57*b*, 57*c*, and 57*d* are sequentially primarily transferred to the intermediate transfer belt 56.

The tension roller 60 applies a fixed tension to the intermediate transfer belt 56. The tension roller 60 is configured in such a way that the intermediate transfer belt 56 has a tension of about 3 kgf to 12 kgf.

The idler roller 61 supports the intermediate transfer belt 56. The idler roller 61 is in an electrically floating state.

The secondary transfer inner roller 62 serving as a secondary transfer member is disposed on a side of an inner face of the intermediate transfer belt 56 to be in contact with the inner face of the intermediate transfer belt 56, and stretches an inner peripheral face of the intermediate transfer belt 56. The secondary transfer inner roller 62 has been formed by using ethylene-propylene-diene rubber (EPDM) or the like, has been formed to have a diameter of 14 mm and a thickness of 0.5 mm, and has been set to have a hardness of, for example, 70° (Asker C). A secondary transfer bias having a polarity that is the same as a charging polarity of toner is applied to the secondary transfer inner roller 62 from the transfer transformer 40.

Here, the secondary transfer bias applied to the secondary transfer inner roller 62 includes both a bias applied in the secondary transfer ATVC control processing (described later), and a bias applied at the time of secondarily transferring a toner image from the intermediate transfer belt 56 to a sheet P during image formation.

The driving roller 63 is driven by a motor having satisfactory speed stability to drive the intermediate transfer belt 56 in a circulating manner in a predetermined circling direction.

The secondary transfer outer roller 64 is disposed to face the secondary transfer inner roller 62 with the intermediate transfer belt 56 interposed therebetween, and is disposed on a side of a toner image bearing face of the intermediate transfer belt 56. The secondary transfer outer roller 64 includes an elastic layer including nitrile rubber (NBR), ethylene-propylene-diene rubber, or the like, and a grounded core metal, and has been formed to have a diameter of 20 mm. The secondary transfer outer roller 64 is connected to a ground.

The intermediate transfer belt cleaning device 65 is provided on a downstream side in the circling direction of the intermediate transfer belt 56 of the secondary transfer inner roller 62 and the secondary transfer outer roller 64. The intermediate transfer belt cleaning device 65 removes residual toner or sheet powder on the intermediate transfer belt 56 after secondary transfer, and cleans a surface of the intermediate transfer belt 56.

The primary transfer roller separating mechanism 70 is controlled by the controller 80 to displace the primary transfer roller 54 in the upward/downward direction in FIG. 1, and therefore the intermediate transfer belt 56 abuts onto or is separated from the photosensitive drum 50.

The controller 80 comprehensively controls the image forming apparatus 1. The controller 80 includes a CPU 82, a ROM 83, and a RAM 84.

The CPU 82 serving as a control portion reads and executes a control program stored in the ROM 83, and therefore the CPU 82 performs predetermined arithmetic processing or the like while transferring or reading data to/from the ROM 83 or the RAM 84, and controls an operation of the entirety of the image forming apparatus 1. An image forming signal including image data, a control command, or the like is input to the CPU 82 from a not-illustrated external host apparatus, such as an image reading apparatus or a personal computer. The CPU 82 performs an image forming operation according to the image forming signal that has been input from the external host apparatus, or a signal that has been input from the operation portion 81.

For example, the CPU 82 performs appropriate control according to a sheet type that is indicated by the signal input from the operation portion 81, and has been designated by a user. Here, the sheet type has been classified into plural classes based on a combination of a material of a sheet P, such as a woodfree sheet or a coated sheet, surface characteristics or the like of the sheet P, and a basis weight of the sheet P. In a case where a user has not designated the sheet type, the CPU 82 selects one of the plural classes of the sheet type, and performs appropriate control according to a sheet type of the selected class.

The CPU 82 performs secondary transfer ATVC control processing serving as secondary transfer bias determination control processing for determining, before image formation, a secondary transfer bias to be applied to the secondary transfer inner roller 62 from the transfer transformer 40 during image formation. Specifically, the CPU 82 determines a secondary transfer bias to be applied to the secondary transfer inner roller 62 during image formation, based on a current value of a current that flows through the secondary transfer inner roller 62 due to constant current control, and a secondary transfer bias indicated by an electric signal that has been input from the voltage detecting portion 42.

A control program, a data table obtained in advance, or the like is stored in the ROM 83.

The RAM 84 is a rewritable memory. Information that has been input from the controller 80, a result of an arithmetic operation performed by the controller 80, and the like are stored in the RAM 84.

<Operation of Transfer Device>

An operation of the transfer device 2 according to the embodiment of the present invention is described in detail with reference to FIGS. 4A to 4C.

Figure 4A:
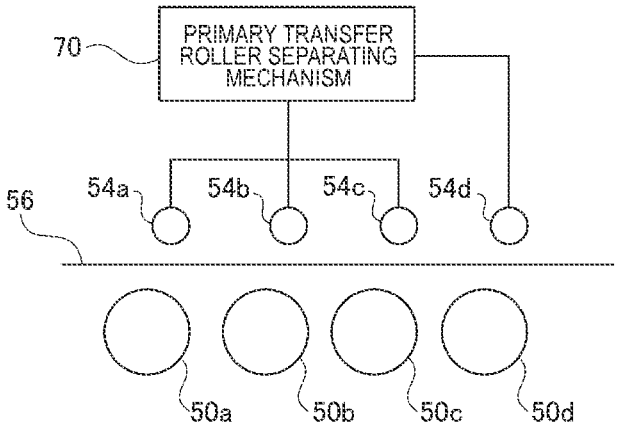
FIGS. 4A, 4B, and 4C are schematic diagrams illustrating an operation of the transfer device according to the embodiment of the present invention.
Figure 4B:
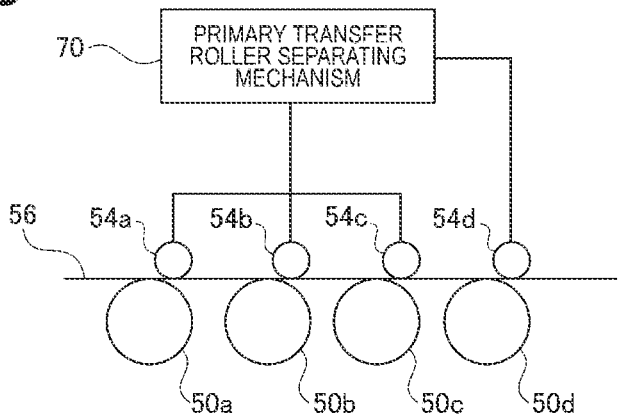
Figure 4C:
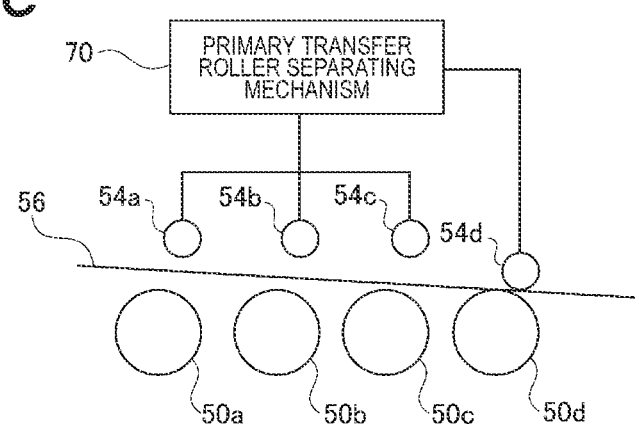

In FIGS. 4A to 4C, FIG. 4A illustrates a completely detached state of the primary transfer roller 54, FIG. 4B illustrates a completely attached state of the primary transfer roller 54, and FIG. 4C illustrates a black attached state of the primary transfer roller 54.

The CPU 82 of the controller 80 performs an image forming operation when a print job has been input, and executes an appropriate image formation mode based on image data that has been input from a not-illustrated external host apparatus. In a case where a user has designated an image formation mode by using an electric signal input from the operation portion 81, the CPU 82 executes the image formation mode designated by the user. Specifically, the CPU 82 executes, as the image formation mode, a full-color mode for forming a color image, or a monochrome mode for forming a monochrome image.

The CPU 82 controls the primary transfer roller separating mechanism 70 according to a determined image formation mode to cause the primary transfer roller 54 of the transfer device 2 to enter into an appropriate state, and determines whether the image forming operation will be performed in the image forming units 57*a*, 57*b*, 57*c*, and 57*d*. In addition, the primary transfer roller separating mechanism 70 is driven, and therefore the primary transfer roller 54 of the transfer device 2 can have three states, the completely detached state, the completely attached state, and the black attached state.

Specifically, in a case where the image formation mode is not executed, the CPU 82 does not perform image formation control on all of the image forming units 57*a*, 57*b*, 57*c*, and 57*d*. In addition, in a case where the image formation mode is not executed, the primary transfer rollers 54*a*, 54*b*, 54*c*, and 54*d* enter into the completely detached state. At this time, the primary transfer rollers 54*a*, 54*b*, 54*c*, and 54*d* separate the intermediate transfer belt 56 from all of the photosensitive drums 50*a*, 50*b*, 50*c*, and 50*d*, as illustrated in FIG. 4A.

In a case where the full-color mode is executed, the CPU 82 performs image formation control on all of the image forming units 57*a*, 57*b*, 57*c*, and 57*d*. By doing this, the image forming units 57*a*, 57*b*, 57*c*, and 57*d* start the image forming operation in order from a most upstream side in the circling direction of the intermediate transfer belt 56. In addition, in a case where the full-color mode is executed, the primary transfer rollers 54*a*, 54*b*, 54*c*, and 54*d* enter into the completely attached state. At this time, the primary transfer rollers 54*a*, 54*b*, 54*c*, and 54*d* cause the intermediate transfer belt 56 to abut onto all of the photosensitive drums 50*a*, 50*b*, 50*c*, and 50*d*, as illustrated in FIG. 4B.

In a case where the monochrome mode is executed, the CPU 82 performs image formation control on the image forming unit 57*d* of black, and does not perform image formation control on the image forming units 57*a*, 57*b*, and 57*c* of yellow, magenta, and cyan. By doing this, only the image forming unit 57*d* that is located on a most downstream side in the circling direction of the intermediate transfer belt 56 performs the image forming operation. In addition, the primary transfer rollers 54*a*, 54*b*, 54*c*, and 54*d* enter into the black attached state in the monochrome mode.

At this time, as illustrated in FIG. 4C, the primary transfer rollers 54*a*, 54*b*, and 54*c* separate the intermediate transfer belt 56 from the photosensitive drums 50*a*, 50*b*, and 50*c*, and the primary transfer roller 54*d* causes the intermediate transfer belt 56 to abut onto the photosensitive drum 50*d*.

Next, after the drive of the intermediate transfer belt 56 has become stable and before a sheet P is conveyed to the secondary transfer inner roller 62 and the secondary transfer outer roller 64, the CPU 82 starts to perform primary transfer processing and perform secondary transfer ATVC control processing.

In the primary transfer processing, in a case where the image formation mode is not executed, the CPU 82 does not apply a primary transfer bias to the primary transfer rollers 54*a*, 54*b*, 54*c*, and 54*d* from the high-voltage power supply 30. In addition, in a case where the full-color mode is executed, the CPU 82 applies the primary transfer bias to the primary transfer rollers 54*a*, 54*b*, 54*c*, and 54*d* from the high-voltage power supply 30. Furthermore, in a case where the monochrome mode is executed, the CPU 82 does not apply the primary transfer bias to the primary transfer rollers 54*a*, 54*b*, and 54*d* from the high-voltage power supply 30, and applies the primary transfer bias to the primary transfer roller 54*d* from the high-voltage power supply 30.

<Secondary Transfer ATVC Control Processing>

Secondary transfer ATVC control processing according to the embodiment of the present invention is described in detail.

Secondary transfer ATVC control processing starts to be performed, after the drive of the intermediate transfer belt 56 has become stable and before a sheet P is conveyed to the secondary transfer inner roller 62 and the secondary transfer outer roller 64.

First, the CPU 82 performs constant current control to apply a secondary transfer bias that corresponds to a preset target current Itg, to the secondary transfer inner roller 62 from the transfer bias output portion 41 in the transfer transformer 40.

Next, the voltage detecting portion 42 in the transfer transformer 40 detects a voltage that has been generated in the transfer bias output portion 41 and the secondary transfer inner roller 62 during a predetermined time period. Here, the predetermined time period is, as an example, a time period required for the secondary transfer outer roller 64 to rotate one time. Then, the CPU 82 determines a mean of the voltage detected by the voltage detecting portion 42 during the predetermined time period to be a base voltage Vb.

Next, the CPU 82 starts the image forming operation, and obtains a voltage value Vtr (Vtr=Vb+Vp) in which a sheet divided voltage Vp that has been set based on a sheet type and environmental information has been added. At this time, the CPU 82 acquires environmental information that has been detected by a not-illustrated temperature and humidity sensor that is provided in the image forming apparatus 1. In addition, the CPU 82 sets a sheet divided voltage Vp that is associated with a sheet type and the acquired environmental information in a sheet divided voltage table that has been stored in advance in the ROM 83 and in which a sheet type, environmental information, and a sheet divided voltage Vp are associated with each other.

Then, when a sheet P has been conveyed to the secondary transfer inner roller 62 and the secondary transfer outer roller 64, the CPU 82 causes the obtained voltage value Vtr to be output in a constant voltage state from the transfer bias output portion 41 to the secondary transfer inner roller 62. By doing this, even in a case where a resistance of the secondary transfer outer roller 64 has changed due to a temperature and humidity environment or long-term use, an appropriate secondary transfer bias can be applied to the secondary transfer inner roller 62.

<Timings of Performing Primary Transfer Processing and Secondary Transfer ATVC Control Processing>

Timings of performing primary transfer processing and secondary transfer ATVC control processing according to the embodiment of the present invention is described in detail with reference to FIGS. 5 to 8.

In a case where the primary transfer bias is applied while secondary transfer ATVC control processing is performed, in some cases, current interference occurs between the primary transfer roller 54*d* and the secondary transfer inner roller 62 while secondary transfer ATVC control processing is performed, and this affects the accuracy of secondary transfer ATVC control processing.

Specifically, in secondary transfer ATVC control processing, when a secondary transfer bias that corresponds to a target current Itg has been applied to the secondary transfer inner roller 62, a negative current (hereinafter referred to as a "leakage current) flows from the secondary transfer inner roller 62 into the primary transfer roller 54*d* in some cases. In these cases, the negative current that flows from the secondary transfer inner roller 62 via the intermediate transfer belt 56 into the secondary transfer outer roller 64 becomes smaller than the target current Itg, and the accuracy of secondary transfer ATVC control processing deteriorates. The accuracy of secondary transfer ATVC control processing deteriorates as the leakage current increases. As a result of this, at the time of image formation, a current fails to be satisfactorily supplied to the secondary transfer inner roller 62, secondary transfer performance deteriorates, and this causes defective transfer.

Figure 7:
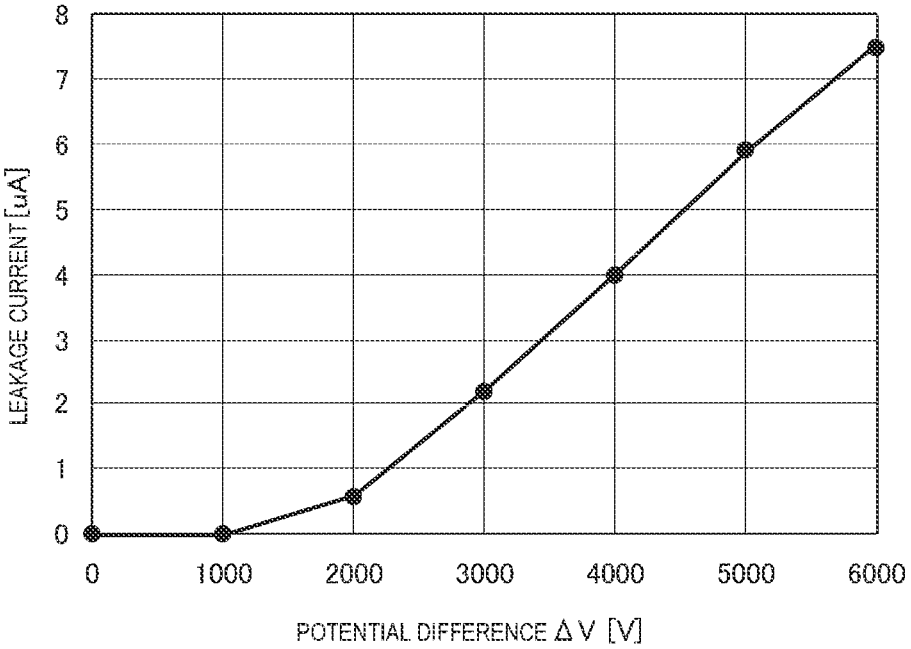
FIG. 7 is a diagram illustrating a relationship between a potential difference and a leakage current in the transfer device according to the embodiment of the present invention.

In addition, the leakage current significantly depends on an electric resistance of the intermediate transfer belt 56, and a potential difference ΔV between the primary transfer roller 54*d* and the secondary transfer inner roller 62. Therefore, in performing secondary transfer ATVC control processing, it is desirable that the potential difference ΔV be smaller. Specifically, as illustrated in FIG. 7, a value of the leakage current increases as the potential difference ΔV increases.

FIG. 8 illustrates a list of the leakage current and a situation of generation of a defective transfer image in a case where it is assumed that the target current Itg is −20 μA. In FIG. 8, it is assumed that image evaluation is subjective evaluation in visual observation, and it is assumed that ○ is determined in a case where defective transfer does not occur, Δ is determined in a case where defective transfer slightly occurs, and x is determined in a case where defective transfer obviously occurs.

A desirable level of image evaluation is ○ or Δ. Accordingly, as is apparent from FIG. 8, it is desirable that the leakage current be reduced to 3 μA or less.

A polarity of the primary transfer bias applied to the primary transfer roller 54*d* is opposite to a polarity of the secondary transfer bias applied to the secondary transfer inner roller 62. Therefore, in a case where the primary transfer bias and the secondary transfer bias are simultaneously applied, the potential difference ΔV increases, and the leakage current increases. Accordingly, while secondary transfer ATVC control processing is performed, it is desirable that the primary transfer bias be prevented from being applied to the primary transfer roller 54*d*. In view of the above, timings of performing primary transfer processing and secondary transfer ATVC control processing in a case where the full-color mode is executed and in a case where the monochrome mode is executed are described in detail below.

Figure 5:
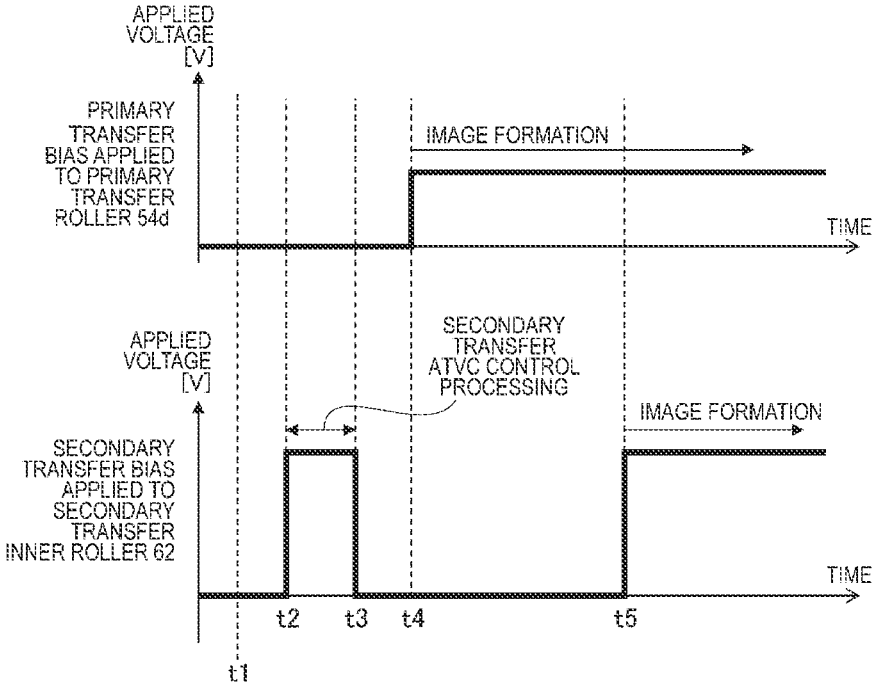
FIG. 5 is a diagram illustrating timings of applying a primary transfer bias and a secondary transfer bias at the time of executing a full-color mode in the transfer device according to the embodiment of the present invention.

First, timings of performing primary transfer processing and secondary transfer ATVC control processing in a case where the full-color mode is executed are described in detail with reference to FIG. 5.

At time t1, the drive of the intermediate transfer belt 56 becomes stable.

At time t2, the CPU 82 starts to perform secondary transfer ATVC control processing, and causes the secondary transfer bias to be applied from the transfer bias output portion 41 of the transfer transformer 40 to the secondary transfer inner roller 62.

At time t3, the CPU 82 terminates performing secondary transfer ATVC control processing, and stops the application of the secondary transfer bias from the transfer bias output portion 41 to the secondary transfer inner roller 62.

At time t4, the CPU 82 starts to perform primary transfer processing, and causes the primary transfer bias to be applied from the high-voltage power supply 30 to the primary transfer roller 54.

In addition, until time t4 elapses, the CPU 82 stops the application of the primary transfer bias from the high-voltage power supply 30 to the primary transfer roller 54. By doing this, while secondary transfer ATVC control processing is performed, the application of the primary transfer bias to the primary transfer roller 54 is stopped.

At time t5, the CPU 82 starts to perform secondary transfer processing, and causes the secondary transfer bias to be applied from the transfer bias output portion 41 to the secondary transfer inner roller 62 based on a voltage value Vtr that has been set in secondary transfer ATVC control processing.

As described above, the CPU 82 performs secondary transfer ATVC control processing in a time period from time t1 at which the drive of the intermediate transfer belt 56 becomes stable to time t4 at which the primary transfer bias is applied to the primary transfer roller 54*d*. In this case, the time period from time t1 to time t4 is longer than a time period during which the secondary transfer outer roller 64 rotates one time. Therefore, the CPU 82 determines a time period during which secondary transfer ATVC control processing is performed to be the time period during which the secondary transfer outer roller 64 rotates one time.

Note that in the present example, in order to reduce FCOT that is a time period after a printing instruction is issued and before a first sheet is output, in a case where the full-color mode is executed, the configuration described below is employed. Specifically, at least one of the image forming units 57*a*, 57*b*, and 57*c* located on the upstream side of the image forming unit 57*d* (a black image forming portion) located on a most downstream side is configured in such a way that a period of secondary transfer ATVC control processing at least partially overlaps an image formation period (a primary transfer period). In the present embodiment, at least the image forming unit 57*a* located on a most upstream side is configured in such a way that the primary transfer period overlaps the period of secondary transfer ATVC control processing.

Figure 6:
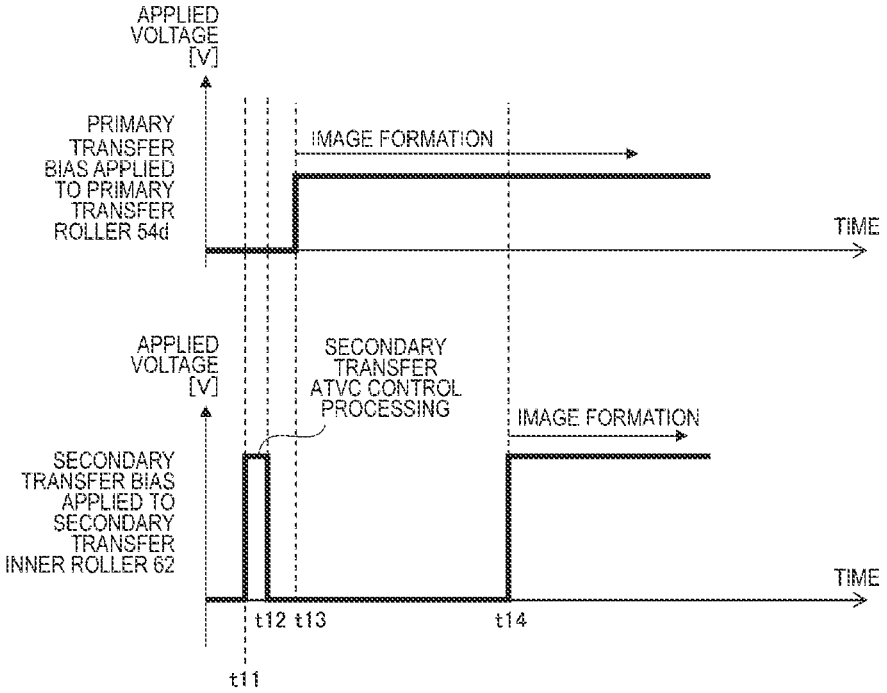
FIG. 6 is a diagram illustrating timings of applying the primary transfer bias and the secondary transfer bias at the time of executing a monochrome mode in the transfer device according to the present invention.

Next, timings of performing primary transfer processing and secondary transfer ATVC control processing in a case where the monochrome mode is executed are described in detail with reference to FIG. 6.

At time t11, the drive of the intermediate transfer belt 56 becomes stable, and the CPU 82 starts to perform secondary transfer ATVC control processing, and causes the secondary transfer bias to be applied from the transfer bias output portion 41 of the transfer transformer 40 to the secondary transfer inner roller 62.

At time t12, the CPU 82 terminates performing secondary transfer ATVC control processing, and stops the application of the secondary transfer bias from the transfer bias output portion 41 to the secondary transfer inner roller 62.

At time t13, the CPU 82 starts to perform primary transfer processing, and causes the primary transfer bias to be applied from the high-voltage power supply 30 to the primary transfer roller 54.

In addition, until time t13 elapses, the CPU 82 stops the application of the primary transfer bias from the high-voltage power supply 30 to the primary transfer roller 54. By doing this, while secondary transfer ATVC control processing is performed, the application of the primary transfer bias to the primary transfer roller 54 is stopped.

At time t14, the CPU 82 starts to perform secondary transfer processing, and causes the secondary transfer bias to be applied from the transfer bias output portion 41 to the secondary transfer inner roller 62 based on a voltage value Vtr that has been set in secondary transfer ATVC control processing.

The CPU 82 performs secondary transfer ATVC control processing in a time period from time t11 at which the drive of the intermediate transfer belt 56 becomes stable to time t13 at which the primary transfer bias is applied to the primary transfer roller 54*d*. In this case, the time period from time t11 to time t13 is shorter than a time period required for the secondary transfer outer roller 64 to rotate one time, and is longer than a time period required for the secondary transfer outer roller 64 to rotate half. Therefore, the CPU 82 determines a time period during which secondary transfer ATVC control processing is performed to be the time period required for the secondary transfer outer roller 64 to rotate half.

As described above, in a case where the monochrome mode is executed, the CPU 82 reduces a time period required for secondary transfer ATVC control processing in comparison with a case where the full-color mode is executed. By doing this, in executing the monochrome mode, the accuracy of secondary transfer ATVC control processing can be prevented from deteriorating without delay of a print job.

In addition, the CPU 82 starts and completes secondary transfer ATVC control processing before primary transfer processing is started, that is, before the primary transfer bias starts to be applied. By doing this, according to the present embodiment, the potential difference ΔV can be reduced in comparison with a case where the primary transfer bias is applied while secondary transfer ATVC control processing is performed. Therefore, the leakage current can be reduced, and the accuracy of secondary transfer ATVC control processing can be prevented from deteriorating.

In addition, in executing the monochrome mode, secondary transfer ATVC control processing starts to be performed at a timing at which the driving state of the intermediate transfer belt 56 has become stable. Therefore, a time period during which secondary transfer ATVC control processing is performed can be increased.

Moreover, while secondary transfer bias determination control processing is performed, the application of the primary transfer bias to the primary transfer roller 54*d* that is closest to the secondary transfer inner roller 62 from among the primary transfer rollers 54 is stopped. Therefore, the leakage current can be reliably reduced.

Here, an influence on an image at a time when constant current control has been performed to apply a secondary transfer bias that corresponds to a target current Itg—20 μA to the secondary transfer inner roller 62 was checked.

First, in a case where secondary transfer ATVC control processing started to be performed in a state where a primary transfer bias of 1500 V was applied, a base voltage Vb is 2500 V, a potential difference ΔV is 4000 V, a leakage current is about −4 μA, and defective image transfer was discovered.

In contrast, as described in the present embodiment, in a case where the application of the primary transfer bias was stopped while secondary transfer ATVC control processing was performed, a base voltage Vb is 2800 V, a potential difference ΔV is 2800 V, a leakage current is about −2 μA, and a satisfactory image was obtained. It can be confirmed from this that in the present embodiment, the accuracy of secondary transfer ATVC control processing can be prevented from deteriorating.

Note that at the time of image formation, the CPU 82 performs constant voltage control to apply, as a secondary transfer bias, a voltage value Vtr obtained by adding a sheet divided voltage Vp to a base voltage Vb. By doing this, a potential difference ΔV is larger by the sheet divided voltage Vp than a potential difference ΔV at the time of performing secondary transfer ATVC control processing, and the leakage current increases. However, in a case where a secondary transfer bias that has been determined by performing secondary transfer ATVC control processing is applied by performing constant voltage control, a current that flows through the secondary transfer inner roller 62 does not decrease even if the leakage current increases, and defective transfer does not occur.

In the present embodiment, while secondary transfer ATVC control processing is performed, the application of the primary transfer bias to the primary transfer roller 54 is stopped. By doing this, interference between a current that flows through the primary transfer roller 54 and a current that flows through the secondary transfer inner roller 62 and the secondary transfer outer roller 64 can be reduced without causing defective transfer at the time of image formation, and an increase in size of an apparatus and an increase in a cost can be avoided.

The present invention is not limited to the embodiment described above, and needless to say, a variety of variations can be made without departing from the gist of the present invention.

Specifically, in the embodiment described above, a time period during which secondary transfer ATVC control processing is performed has been determined to be a time period required for the secondary transfer outer roller 64 to rotate one time or a time period required to rotate half. However, the time period during which secondary transfer ATVC control processing is performed can be determined to be an arbitrary predetermined time period. However, this arbitrary predetermined time period is determined to be a time period that is shorter than a time period from the time at which the drive of the intermediate transfer belt 56 becomes stable to the time at which a primary transfer bias is applied to the primary transfer roller 54*d*.

In addition, in the embodiment described above, a plurality of primary transfer rollers 54 has been provided, but this is not restrictive, and a single primary transfer roller may be provided.

Further, in the embodiment described above, while secondary transfer ATVC control processing is performed, the application of the primary transfer bias to the primary transfer roller 54*d* has been stopped. However, this is not restrictive, and while secondary transfer ATVC control processing is performed, the application of the primary transfer bias to an arbitrary number of primary transfer rollers 54 from a downstream side of the circling direction of the intermediate transfer belt 56 may be stopped.

In addition, in the embodiment described above, in secondary transfer ATVC control processing, constant current control has been employed as a test bias. However, this is not restrictive, and in secondary transfer ATVC control processing, a current that has been supplied to the secondary transfer inner roller 62 and the secondary transfer outer roller 64 at the time of applying a test bias on which constant voltage control has been performed may be detected by a detecting portion. Then, a secondary transfer bias may be set based on a current value detected by the detecting portion.

According to the present invention, interference between currents that respectively flow through a primary transfer portion and a secondary transfer portion can be reduced without causing defective transfer at the time of image formation, and an increase in size of an apparatus and an increase in a cost can be avoided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-139760, filed Aug. 30, 2021, which is hereby incorporated by reference herein in its entirety.

What is claimed is:

1. An image forming apparatus comprising:

an image forming portion configured to form a toner image on an image bearing member;

a belt to which the toner image is transferred from the image bearing member;

a primary transfer member configured to primarily transfer the toner image from the image bearing member to the belt;

a first application portion configured to apply a voltage to the primary transfer member;

a secondary transfer member configured to come into contact with an inner face of the belt and stretch the belt, and to secondarily transfer the toner image from the belt to a recording material;

a second application portion configured to apply a voltage to the secondary transfer member;

a sensing portion configured to sense a current that flows through the secondary transfer member, or the voltage that has been applied; and a controller configured to perform an operation to determine a transfer voltage to be applied to the secondary transfer member in secondary transfer, on a basis of a result of sensing performed by the sensing portion at a time when a test voltage has been applied to the secondary transfer member in non-image formation, wherein in the operation, the controller controls the first application portion and the second application portion not to apply the voltage to the primary transfer member during a period of applying the test voltage to the secondary transfer member.

2. The image forming apparatus according to claim 1, wherein the controller performs control to determine the period of applying the test voltage in a case where the operation is performed in monochrome image formation to be a first application time period, and determine the period of applying the test voltage in a case where the operation is performed in full-color image formation to be a second application time period that is longer than the first application time period.

3. The image forming apparatus according to claim 1, wherein the controller performs control to determine a time period from a driving start timing of the belt to start of the operation in a case where the operation is performed in monochrome image formation to be a first time period, and determine the time period in a case where the operation is performed in full-color image formation to be a second time period that is longer than the first time period, the driving start timing being a timing at which the belt starts to be driven according to start of image formation.

4. The image forming apparatus according to claim 1, wherein the primary transfer member includes a metal roller.

5. The image forming apparatus according to claim 4, wherein a surface resistivity of the belt is greater than or equal to 1E+10 Ω/sq, and is less than or equal to 1E+11 Ω/sq.

6. The image forming apparatus according to claim 4, wherein the primary transfer member is disposed not to cause a first contact portion and a second contact portion to overlap each other in a direction of movement of the belt, the primary transfer member being in contact with the belt in the first contact portion, the image bearing member being in contact with the belt in the second contact portion.

7. An image forming apparatus comprising:

a plurality of image forming portions including a plurality of image bearing members that bear toner images;

a belt to which the toner images are transferred from the plurality of image bearing members;

a plurality of primary transfer members configured to primarily transfer the toner images from the plurality of image bearing members to the belt;

a first application portion configured to apply a voltage to the plurality of primary transfer members;

a secondary transfer member configured to come into contact with an inner face of the belt and stretch the belt, and to secondarily transfer the toner images from the belt to a recording material;

a second application portion configured to apply a voltage to the secondary transfer member;

a sensing portion configured to sense a current that flows through the secondary transfer member, or the voltage that has been applied; and a controller configured to perform an operation to determine a transfer voltage to be applied to the secondary transfer member in secondary transfer, on a basis of a result of sensing performed by the sensing portion at a time when a test voltage has been applied to the secondary transfer member in non-image formation, wherein in the operation, the controller controls the first application portion and the second application portion to apply the voltage to a primary transfer member that is located on a most upstream side in a direction of rotation of the belt from among the plurality of primary transfer members, and not to apply the voltage to a primary transfer member that is located on a most downstream side, during a period of applying the test voltage to the secondary transfer member.

* * * * *